US006022387A

United States Patent [19]

Asplund

[11] Patent Number: 6,022,387

[45] Date of Patent: Feb. 8, 2000

[54] METHOD FOR MAXIMIZING POWER OUTPUT WITH REGARD TO FUEL QUALITY WHEN BURNING SOLID FUELS

[76] Inventor: Frank Asplund, Hornsgatan 59 A, S-118 49, Stockholm, Sweden

[21] Appl. No.: 08/991,486

[22] Filed: Dec. 16, 1997

[51] Int. Cl.[7] ..... C01J 3/06

[52] U.S. Cl. ..... 48/197 R; 422/111

[58] Field of Search ..... 48/197 R, 127.9; 110/186; 422/111

[56] References Cited

U.S. PATENT DOCUMENTS

| | | | |
|---|---|---|---|
| 3,605,655 | 9/1971 | Warshawsky et al. | 110/186 |
| 3,746,521 | 7/1973 | Giddings | 48/111 |
| 4,321,877 | 3/1982 | Schmidt et al. | 110/186 |
| 4,489,562 | 12/1984 | Snyder et al. | 60/667 |
| 4,666,462 | 5/1987 | Martin | 48/197 R |
| 4,676,734 | 6/1987 | Foley | 431/112 |
| 5,230,293 | 7/1993 | Schirmer | 110/346 |
| 5,656,044 | 8/1997 | Bishop et al. | 48/197 R |

FOREIGN PATENT DOCUMENTS

| | | |
|---|---|---|
| 005540A1 | 7/1982 | European Pat. Off. . |
| 0137461 A2 | 4/1985 | European Pat. Off. . |
| 3509263 A1 | 10/1986 | Germany . |

*Primary Examiner*—Hien Tran
*Attorney, Agent, or Firm*—Birch, Stewart. Kolasch & Birch, LLP

[57] ABSTRACT

A method for maximizing the power in regard to the fuel quality when burning solid fuels, especially biomass and peat. The maximizing of the power is performed within the limits for the plants maximum permitted power production, and at the same time with regard to the maximum achievable power with the fuel quality in use. The maximizing of the power with regard to the fuel may either be controlled by the temperature changes in the fuel gas emerging from the fuel bed or by the fuel moisture content with regard to the fuel actually processed in the gasifier. The maximum allowable gasification air flow in regard to the fuel quality can either be theoretically or empirically evaluated.

13 Claims, No Drawings

METHOD FOR MAXIMIZING POWER OUTPUT WITH REGARD TO FUEL QUALITY WHEN BURNING SOLID FUELS

FIELD OF THE INVENTION

The present invention concerns a method for maximizing power output with regard to fuel quality when burning solid fuels, such as peat and biomass fuels.

BACKGROUND OF THE INVENTION

In a gasifier used for production of combustible gas (fuel gas) from solid fuels—in particular peat and biomass fuels—the gasifier power is dependent on the gasification air flow (i.e. the primary air flow). The relationship between the gasifier power and the gasification air flow is valid independent of the procedure for the fuel input to the gasifier, except for the case when the fuel flow is limiting the gasifier power. Therefore, this relationship is valid for both fluidized beds and fixed fuel beds including fluid bed boilers, conventional fixed bed boilers and the more specific co-current gasifiers and counter-current gasifiers. Thus, all of these different boilers used for burning solid fuels form a combination of a gasifier (i.e. gasproducer) and a gas burner. The more specific difference between the different boiler types is the appearance of the combination of the gas producer and the gas burner. Independently of the appearance of the combination, the two different process stages anyhow do exist.

Boilers and gasifiers for solid fuels are usually designed for a very narrow interval with regard to fuel quality. This means that combustion equipment is constructed for fuels having high moisture contents, for comparatively dry fuel and finally for very dry fuel, i.e. usually pelleted fuel. If a boiler plant designed for using dry fuel or very dry fuel is used for burning wet fuel, i.e. fuel with a high moisture content, the result regarding combustion quality is usually very poor. Contrary, if a boiler designed for burning fuel with a high moisture content is used for burning dry fuel, insuperable problems usually will arise in connection with the fuel ash handling. Although gasifiers (i.e. gas producers) exist operating almost without problems when using both wet and dry fuel, a remaining problem is that the gasification air flow (i.e. the primary air flow) often gets too high when the fuel quality is decreased. This excessive air flow then will cool down the gasification process, which causes a gasification power reduction because of the strong relationship between gasification process temperature and gasification power.

SUMMARY OF THE INVENTION

The present invention aims at controlling the primary air flow (or the total air flow) in order to maximize the gasification air flow, causing the gasifier to allow the highest possible power production with the fuel actually in use. This means that the boiler always will produce the highest possible power (permitted by the actual fuel) independently of the fuel quality. It also means that extinction caused by cooling down the gasification process is prevented in case of very wet fuel in connection with a very high power requirement.

The gasifier production of fuel gas (i.e. the gasifier power) is regulated with the gasification air flow. Decreasing the gasification air flow causes lower gasifier power and vice versa. However, if the gasification air flow (i.e. the primary air flow) is increased to a too high level, the gasifier power will not correspond to the gasification air flow increase. In certain cases the gasification air flow increase will cause a large reduction in gasification power instead of power increase. In respect of the fuel quality (type of fuel, volatile matters, exposed fuel surface and finally fuel moisture content) an upper chemical reaction limit exists. This chemical reaction limit means that an excess of gasification air will cause power reduction instead of a power increase. The worst case means that a too high gasification air flow will cause extinction of the whole process.

Consequently, the effect of gasification excess air flow causes a reduction in the gasification temperature. This temperature reduction can be noticed by measuring the temperature either in the gasification volume itself or in its vicinity. For fixed bed co-current gasifiers (upstream gasifiers) the decreasing temperature in the gasifier reaction zone may be monitored by measuring the decreasing temperature in the fuel gas flow leaving the fuel bed (i.e. in the free board). When limiting the gasification air flow in such a way that this temperature always will be maximized, a maximum power related to the fuel quality always will be delivered from the gasifier (i.e. the fuel gas producer) independently of the fuel quality.

The highest possible gasifier power production with regard to the actual fuel quality will occur by controlling the gasification air flow in a such a way that this air flow is limited upwards (within the design criteria) to give the highest possible gasifier power, which means that no gasification excess air may exist. This control can be arranged in such a way that the above mentioned temperature is recorded as a function of time. With enough recordings stored, an approximate first degree function of temperature versus time is evaluated. The function may (as an example) be evaluated using the least square method. The function is thereafter used to control if the average temperature is increasing, constant or decreasing (i.e. if the direction coefficient for the function is positive (+), zero (0) or negative (−)). If the direction coefficient is positive (i.e. the temperature as a function of the time has in average been higher) or zero (the temperature has in average been constant), this will be understood in such a way that the gasification process allows higher power production. A negative direction coefficient is understood in such a way that the gasification air flow is too high and therefore has to be decreased in order to increase the gasifier power to the highest possible level in the actual case. When the power requirement is increasing, the gasification air flow is permitted to increase only if the direction coefficient of the function mentioned is positive or zero. In another case (if the direction coefficient is negative) the gasification air flow has to be decreased in order to increase the gasifier power to the maximum level with the actual fuel in use.

In order to get such a control system stable, the linear approximation for the temperature as a function of the time has to be based on a certain number of temperature recordings evenly distributed in the time. The function presented here (as an example) is based on 21 temperature recordings with three minutes between every two records. It follows that the control system in this example is based on an average of one hour. Every time a new temperature is recorded and added to the stored multiple recordings, the oldest temperature record is removed from the multiple stored recordings. In this way the number of temperature recordings will remain constant, which in this example means that the stored temperature recordings will always be 21.

If the fuel quality differs only very little between two control activities, a system of stepwise gasifier air flow control can be used. As an example, the gasification air flow range (from zero to maximum flow) can be divided into 20 equal parts. This means that the gasification air flow will increase or decrease with 5% of the maximum gasification air flow for each control step taken. In order to minimize the control activities (i.e. achieve a stable control system) any change in control activity is prevented before at least three new recordings have been added to the bulk of temperature records (which in this example consists of 21 recordings). Referring to this example, it follows that the waiting time between every control activity is at least nine minutes, which is supposed to be a long enough time in order to make sure that the correct control activity (i.e. increasing or decreasing the gasification air flow) is achieved.

A particular problem will occur if the fuel quality is changing significantly at the time of the control activity. If the fuel quality is changing to the better (i.e. the fuel quality is increasing) no problem will occur because the gasifier power then is permitted to increase. However, the contrary is harder to control. Still using the presented example, initially one decreasing step (5%) of the gasification air flow is performed. After (at least) nine minutes, the control system will cause a new step down (still 5% of the maximum gasification air flow). This will happen because the fuel quality is supposed to still be decreasing, and so on. If the whole fuel bed conversion into energy takes a comparatively long time (30–60 minutes, i.e., a thick fuel bed), the gasification power will decrease to a much lower level than the level corresponding to the maximum power with the actual fuel in use, before stabilization is achieved, so that the power can start to increase to the actual maximum available power. In addition, should different fuel qualities be fed randomly to the gasifier (i.e. for example a mixture of fuel and snow in wintertime), the gasifier power may for a certain time give much less power then the maximum achievable power related to the fuel quality. In the case of a much higher rate of fuel bed conversion (i.e. a thin fuel bed) this reduction in maximum achievable gasifier power is correspondingly less.

When burning biomass and peat, the only factor affecting the fuel quality in such a way, that the gasification air flow has to be limited because of reduced fuel quality, is the moisture content of the fuel. Such a limitation may be arranged by continuously (or almost continuously) measuring the moisture content of the fuel in actual use in the process. With sufficiently small intervals between the moisture samples, the recordings will practically serve as a continuous sampling. For every specific gasifier, the maximum gasification air flow (or total air flow, i.e. the sum of primary air and secondary air) with regard to the fuel moisture content, in most cases has to be found empirically. In a certain plant, the maximum allowable gasification air flow (or total air flow) with regard to the fuel moisture content can automatically be maximized based on continuous (or almost continuous) measurement of the moisture content of the fuel utilized in the specific gasification process. This kind of control will always permit the gasifier to produce the maximum power in regard to the actual fuel in use in the gasification process. This control will also minimize the amount of solid particles in the fuel gas produced in the gasifier because the absence of gasification excess air minimizes the fuel gas flow from the gasifier, and therefore minimizes the ability of the gas flow to bring along solid particles.

Further scope of applicability of the present invention will become apparent from the detailed description given hereinafter. However, it should be understood that the detailed description and specific examples, while indicating preferred embodiments of the invention, are given by way of example only, since various changes and modifications within the spirit and scope of the invention will become apparent to those skilled in the art from this detailed description.

DETAILED DESCRIPTION OF PREFERRED EMBODIMENTS

Examples

A. Gasification air flow maximum control based on measuring the temperature of the fuel gas leaving the fuel bed in the gasifier free board.

The plant has a revolutionary speed controlled forced draft stack gas fan, but no air fan. The boiler plane power is controlled by the speed control of the stack gas fan. The fan maximum speed is limited by a separate control dividing the speed range between minimum and absolute maximum speed in steps. Every step causes the speed to increase or decrease as much as 5% of the absolute maximum speed. Maximizing of the stack gas fan speed will cause a proportional (in respect of the fuel moisture content) maximization of the gasification air flow.

During operation, the following temperatures (Centigrade) have been measured and recorded in the fuel gas flowing from the fuel bed (i.e. in the free board). The time interval between the recordings is three minutes.

| | | | | | | |
|---|---|---|---|---|---|---|
| Rec. No. | 1 | 2 | 3 | 4 | 5 | 6 |
| Deg. C. | 763 | 763 | 763 | 764 | 766 | 767 |
| Rec. No. | 7 | 8 | 9 | 10 | 11 | 12 |
| Deg. C. | 768 | 768 | 769 | 769 | 769 | 770 |
| Rec. No. | 13 | 14 | 15 | 16 | 17 | 18 |
| Deg. C. | 770 | 770 | 769 | 769 | 769 | 769 |
| Rec. No. | 19 | 20 | 21 | 22 | 23 | 24 |
| Deg. C. | 768 | 767 | 766 | 764 | 762 | 760 |
| Rec. No. | 25 | 26 | 27 | 28 | 29 | 30 |
| Deg. C. | 757 | 755 | 755 | 766 | 766 | 766 |
| Rec. No. | 31 | 32 | 33 | 34 | 35 | 36 |
| Deg. C. | 767 | 767 | 767 | 768 | 768 | 768 |
| Rec. No. | 37 | 38 | | | | |
| Deg. C. | 770 | 770 | | | | |

Records No. 1 through No. 21 are used to evaluate a first degree (i.e. linear) time dependent function in order to find out if the average temperature is increasing or decreasing during this time interval. Using the evaluated function, the sign (tk) of the direction coefficient is calculated. The sign (tk) is to be found from the following relationship:

$$tk = \text{sign of } (T(t+\Delta t) - T(t))$$

wherein T(t) is the temp. according to the evaluated function at time t,

T(t+Δt)is the temp. according to the evaluated function at time t+Δt, and

Δt>0.

Since, according to the conditions of the example, the stack gas fan is not allowed to change the limit for the maximum flow within less than three measuring periods (in this case 9 minutes), it is of interest only to determine the sign tk at the following points of time:

| No. | 21 | 24 | 27 | 30 | 33 | 36 etc. |
|---|---|---|---|---|---|---|
| tk | + | — | — | — | — | + |

The reason for using No. 21 as the first point of time is that the recordings started at point No. 1 and that it was supposed as necessary to build up multiple stored recordings consisting of 21 values in order to yet a smooth control. The number of values in the stored multiple recordings has to be constant until it can be changed for any reason.

If the power requirement exceeds the actual power delivered, the fan speed is permitted to increase with 5% of the absolute maximum speed at point No. 21. At point No. 24, however, the sign tk is negative. Consequently, the maximum allowable gasification flow has to be reduced as much as it was increased before, and it follows that the fan speed must be decreased as much as before. At point No. 27, the gasification air flow has to be reduced one step more, and, consequently, the fan speed must once again be reduced by 5% or the absolute maximum fan speed. The same applies to points Nos. 30 and 33. At point No. 36 the gasification flow is permitted to increase, and therefore the maximum fan speed limit will take one step upwards. Supposing that the power requirement exceeds the actual maximum boiler power (limited by the gasifier) the plant will balance the gasifier's maximum allowable power as long as the fuel quality is too low to permit higher power. Also in case the power requirement should be larger than the plant design specifications (with respect to the fuel quality), the maximum power limit will function partly to prevent a low power production and partly to prevent plant (gasifier) extinction.

B. Gasification air flow control based on intermittently measuring the moisture content of a fuel used in a gasification process.

If a boiler plant includes a device for measuring the moisture content of the fuel for the time being used in a gasification process, the measured value may be used as a control impulse in order to control the upper limit of the gasification air flow with regard to the fuel quality. In the same way as with the temperature impulse (Example A), the control may be used for controlling the forced draft fan revolution speed, that causes the total air flow, and then the gasification air flow is to be maximized in regard of the moisture content of the fuel actually used in the gasification process. A prerequisite for a good control is that the measured values are delivered to the controlling device at sufficiently small intervals (such as 2–7 minutes intervals). The control of the maximum gasification air flow then follows a function dependent on the moisture content of the fuel actually processed in the gasifier. This function may be evaluated either theoretically or empirically depending on accessible process data for the plant. Using the measured values representing the moisture content of the fuel as input to the evaluated function, suitable controlling parameters will be received for controlling the gasification air flow. In the case the actual boiler plant is only equipped with a speed controlled forced draft stack gas fan, those parameters will be used for control of the actual maximum fan speed. In other cases the parameters may be used for example to control air or stack gas dampers in order to maximize the gasification air flow.

The invention being thus described, it will be obvious that the same may be varied in many ways. Such variations are not to be regarded as departure from the spirit and scope of the invention, and all such modifications as would be obvious to one skilled in the art were intended to be included within the scope of the following claims.

What is claimed is:

1. A method for maximizing the power output in a combustion plant with regard to the moisture content of the fuel when burning solid fuels, the method comprising the steps of:

determining a maximum gasification air flow for the plant by obtaining a maximum gasifier power according to different moisture contents of the fuel;

determining a relationship between the moisture content of the fuel and at least one of a maximum gasification air flow and a maximum total air flow;

measuring moisture content of the fuel; and controlling the gasification air flow or the total air flow according to the moisture content of the fuel.

2. The method according to claim 1, wherein the step of measuring the moisture content is generally performed at between 2 and 7 minute intervals.

3. The method according to claim 1, wherein the controlling the gasification air flow step includes changing the revolutionary speed of a stack gas fan.

4. The method according to claim 2, wherein the controlling the gasification air flow step includes changing the revolutionary speed of a stack gas fan.

5. The method according to claim 1, wherein the controlling the gasification air flow step includes moving a damper.

6. The method according to claim 2, wherein the controlling the gasification air flow step includes moving a damper.

7. A method for maximizing power output in a combustion plant with regard to a temperature of the fuel when burning solid fuels, the method comprising the steps of:

determining a maximum gasification air flow for the plant by obtaining a maximum gasifier power according to different temperatures of fuel gas exiting a gasifier of said plant;

determining a relationship between the temperature of the fuel gas and at least one of a maximum gasification air flow and a maximum total air flow;

measuring the temperature of said fuel gas at time intervals and recording said measured temperatures;

calculating a first degree function of temperatures recorded versus time;

increasing said air flow if said function has a value greater than or equal to zero; and decreasing said air flow if said function has a value less than zero.

8. The method according to claim 7, wherein the step of measuring and recording the temperature is continuously performed and includes removing an oldest recorded temperature when recording a new temperature.

9. The method according to claim 7, wherein the step of measuring and recording the temperature includes measuring the temperature every third minute and utilizing 21 temperature recordings when forming said function.

10. The method according to claim 7, wherein the increasing and decreasing air flow steps includes changing in a stepwise manner.

11. The method according claim 10, wherein said air flow is changed in the stepwise manner, each stepwise change being 5% of a maximum achievable flow.

12. The method according to claim 7, wherein the increasing and decreasing air flow steps include prohibiting any change of gasification air flow until three new temperature recordings are made since a previous change in air flow.

13. The method according to claim 7, wherein the calculating the first degree function step includes determining a variable tk, where $$tk = \text{sign or } (T(t+\Delta t) - T(t))$$

t is time, Δt is a value greater than zero, T(t) is a temperature of said fuel gas at time t, and T(t+Δt) is temperature of said fuel gas at time t+Δt.

* * * * *